US007712257B2

(12) United States Patent
Johnson

(10) Patent No.: US 7,712,257 B2
(45) Date of Patent: May 11, 2010

(54) DOOR SAFETY DEVICE

(76) Inventor: Mark A. Johnson, 3485 Bedford, Detroit, MI (US) 48224

( * ) Notice: Subject to any disclaimer, the term of this patent is extended or adjusted under 35 U.S.C. 154(b) by 0 days.

(21) Appl. No.: 12/069,931

(22) Filed: Feb. 14, 2008

(65) Prior Publication Data

US 2008/0190029 A1 Aug. 14, 2008

Related U.S. Application Data

(60) Provisional application No. 60/901,142, filed on Feb. 14, 2007.

(51) Int. Cl.
*E05D 11/00* (2006.01)

(52) U.S. Cl. ..... 49/383; 49/384

(58) Field of Classification Search ..... 49/383, 49/384; 160/40, 41
See application file for complete search history.

(56) References Cited

U.S. PATENT DOCUMENTS

| | | | | |
|---|---|---|---|---|
| 2,694,234 A | | 11/1954 | Roby et al. | |
| 3,934,371 A | | 1/1976 | Ulatowski et al. | |
| 4,909,296 A | * | 3/1990 | Sellke et al. | 160/67 |
| 4,941,524 A | * | 7/1990 | Greer | 160/67 |
| 5,359,812 A | * | 11/1994 | Mayfield | 49/383 |
| 5,778,601 A | * | 7/1998 | Wu | 49/383 |
| 6,141,909 A | * | 11/2000 | Hanson | 49/303 |
| 6,298,605 B1 | * | 10/2001 | Delefosse et al. | 49/383 |
| 6,434,888 B1 | * | 8/2002 | Shaw et al. | 49/383 |
| 6,643,980 B1 | * | 11/2003 | Dorder et al. | 49/383 |
| 6,832,450 B1 | * | 12/2004 | Shaharbani | 49/383 |
| 6,931,789 B2 | * | 8/2005 | Stout, Jr. | 49/383 |
| 2002/0157319 A1 | | 10/2002 | Haq | |

FOREIGN PATENT DOCUMENTS

| | | | |
|---|---|---|---|
| DE | 4207385 A1 | * | 9/1993 |
| FR | 2664936 A1 | * | 1/1992 |

* cited by examiner

*Primary Examiner*—Jerry Redman
(74) *Attorney, Agent, or Firm*—Harness, Dickey & Pierce, P.L.C.

(57) ABSTRACT

A safety system for a door-to-door jamb interface is provided. The safety interface uses several slidably joined members which are coupled to the door and its associated door jamb to prevent interaction between a user and the door-to-door jamb interface.

8 Claims, 8 Drawing Sheets

DOOR SAFETY DEVICE

CROSS-REFERENCE TO RELATED APPLICATIONS

This application claims the benefit of U.S. Provisional Application No. 60/901,142, filed on Feb. 14, 2007. The disclosure of the above application is incorporated herein by reference.

FIELD

The present disclosure relates to a safety mechanism for a door structure, and more particularly to a safety enclosure mechanism for a door frame.

BACKGROUND

The statements in this section merely provide background information related to the present disclosure and may not constitute prior art.

Inherent with standard door designs is the relative movement between hard and relatively sharp fixed surfaces. These surfaces often pose hazards to the fingers of children. As such, there is a need to reduce the risk to children caused by the moving surfaces of the door.

SUMMARY

To overcome the deficiencies of standard door system, a safety system is provided. The safety system includes a louvered covering for the door jamb. One side of the louvered cover is coupled to the door, while the second side of the cover is coupled to the door frame.

In one embodiment, a louvered door jamb cover is provided. Each of the members of the louvers are coupled together using a pin and slot system. In this regard, the pins of a first louver member are configured to be slidably received within slots of a second louvered member. It is envisioned that the pins and slots can take a variety of different configurations.

In another embodiment, a pendulum is rotatably coupled to a front or rear face of the door. The pendulum is positioned so as the rotation of the pendulum positions a portion of the pendulum between the door and the door's jamb. A spring biases the pendulum into the location between the door and the door jamb. A user can retract the pendulum to allow the door to close.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

The safe door hinge system disclosed herein is configured to eliminate the danger to fingers or other anatomy created by a door and door jamb coming together at the hinged edge of the door when being closed. In the current design, used almost universally, a pinch point is created when the door and door jamb come together as the door is closed. Current door hinge design consists of two metal plates of equal size joined at one edge by a pivoting joint allowing the plates to open and close leaving no gap between them in the closed position.

Figure 1:
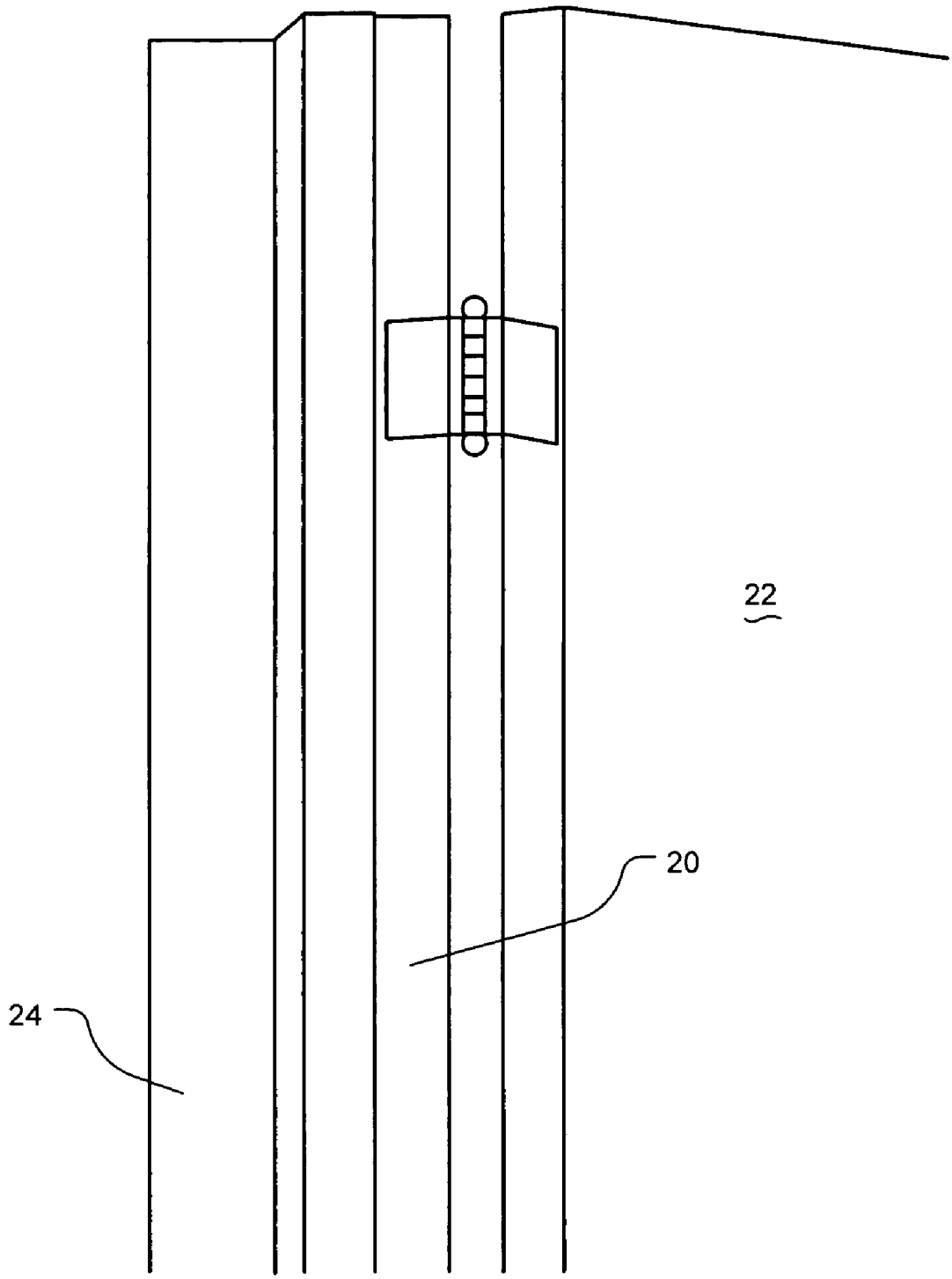
FIG. 1 represents a standard door system.
Figure 2:
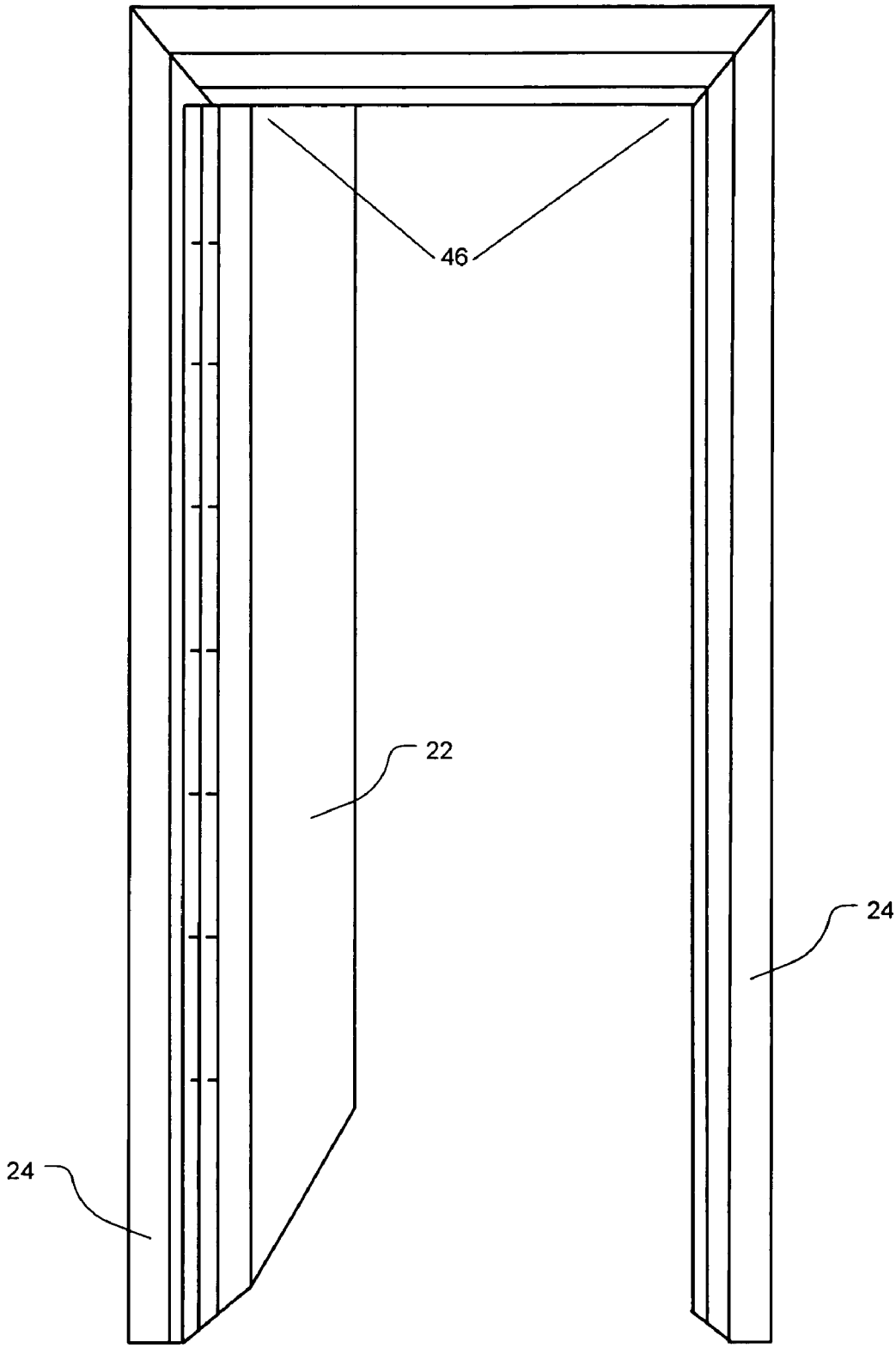
FIG. 2 represents a door safety device according to one embodiment of the teachings.
Figure 3:
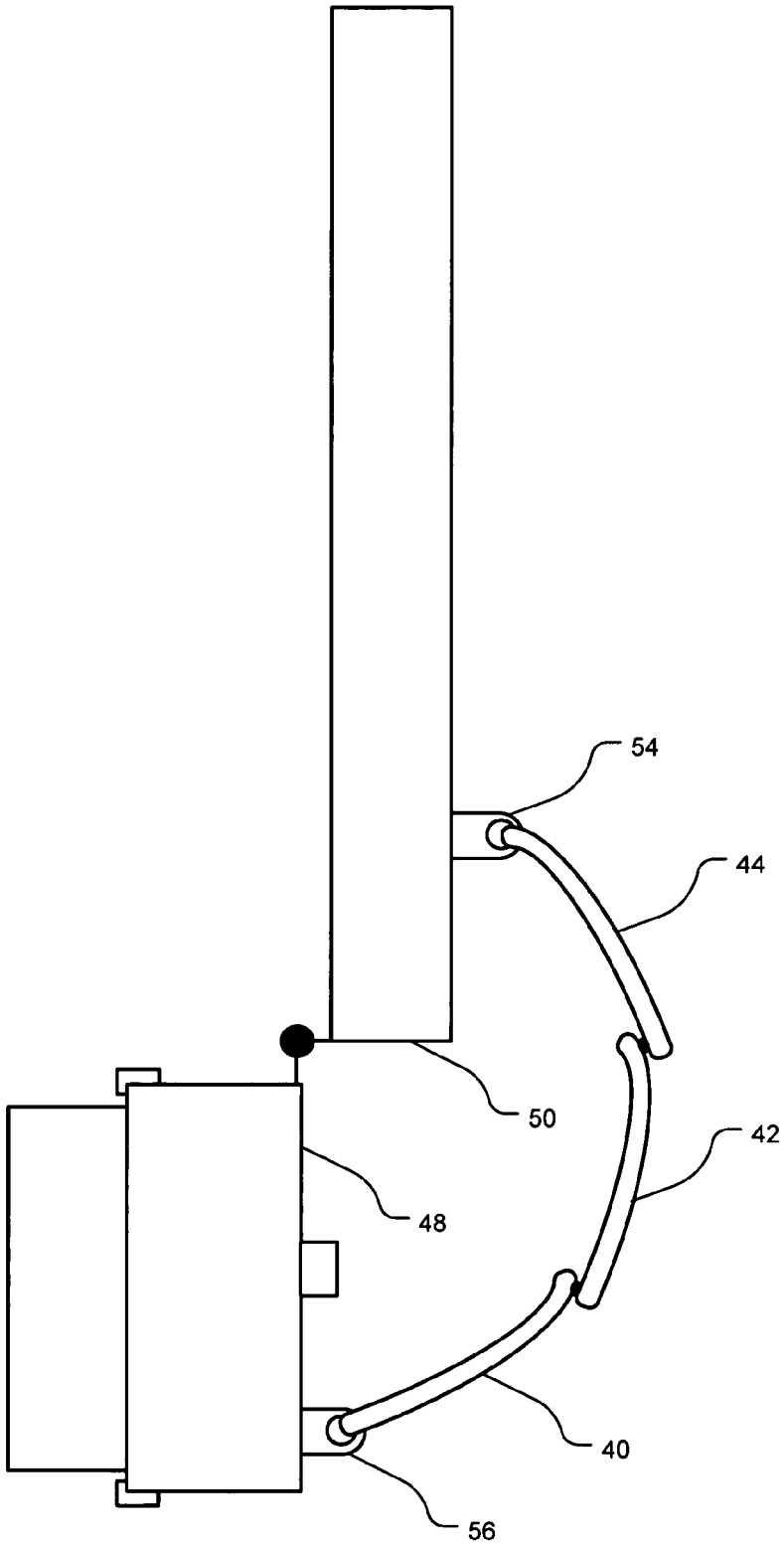
FIG. 3 represents a top view of the system shown in FIG. 2.

A finger guard device 26 is proposed to protect fingers or other anatomy from being injured by the forces produced by a door and door jamb 24 coming together at the hinged edge of a door 22 when being closed. The finger guard 26 covers the gap created between the door and the door jamb when a door is opened, thereby preventing fingers or other anatomy from being inserted and subsequently crushed or pinched when the door is closed. The finger guard 26 retrofits easily to existing doors and be easily removable, using Velcro as one possible means of attachment. The finger guard 26 can be formed of a plurality of polymer elongated curved or flat panels (40, 42, 44) (FIG. 3) running vertically the entire height of the door jamb up to the lintel 46 positioned in layers that would expand and contract horizontally to cover the gap between the door 22 and the jamb 24 as the door is opened or closed.

It is envisioned the panels (40, 42, 44) can be curved or flat and are configured to slide parallel to and behind one another when the door is closed, and expand as the door is opened.

The panels are connected to each other at any number of points along their height by horizontal fastening tracks consisting of a combination of pins and slots, rails and channels, hooks and rods, wheels and tracks, or any other fastening combination that would attach the panels together securely front to back, limit and control the gaps between the panels, and allow the panels to slide back and forth horizontally. The back of the top panel would be attached to the front of the second panel 42 and the back of the second panel would be attached to the front of the last panel 40. The first and last panels would be connected pivotally to the door and the door jamb respectively 54, 56 which would cause the entire device to expand and contract as the door is opened or closed.

A finger guard device 26 is proposed to protect fingers or other anatomy from being injured by the forces produced by a door and door jamb coming together at the hinged edge of a door when being closed. The finger guard 26 covers the gap created between the door and the door jamb when a door is opened thereby preventing fingers or other anatomy from being inserted and subsequently crushed or pinched when the door is closed. The finger guard would retrofit easily to existing doors and be easily removable using Velcro as one possible means of attachment. The finger guard would consist of any number of elongated panels 40, 42, 44 running vertically the entire height of the door jamb up to the lintel 46 positioned in layers that would expand and contract horizontally to cover the gap between the door 50 and the jamb 48 as the door is opened or closed. A portion of the elongated panels nest when the door is in an open position.

Figure 4:
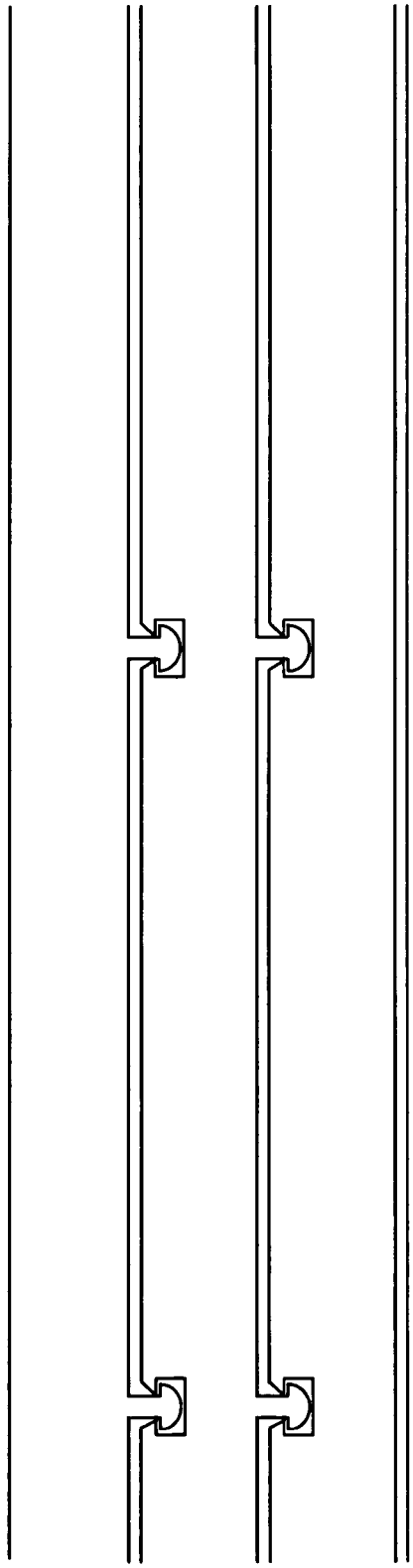
FIGS. 4 and 5 represent cross-sectional views of the louvered system according to the teachings herein.
Figure 5:
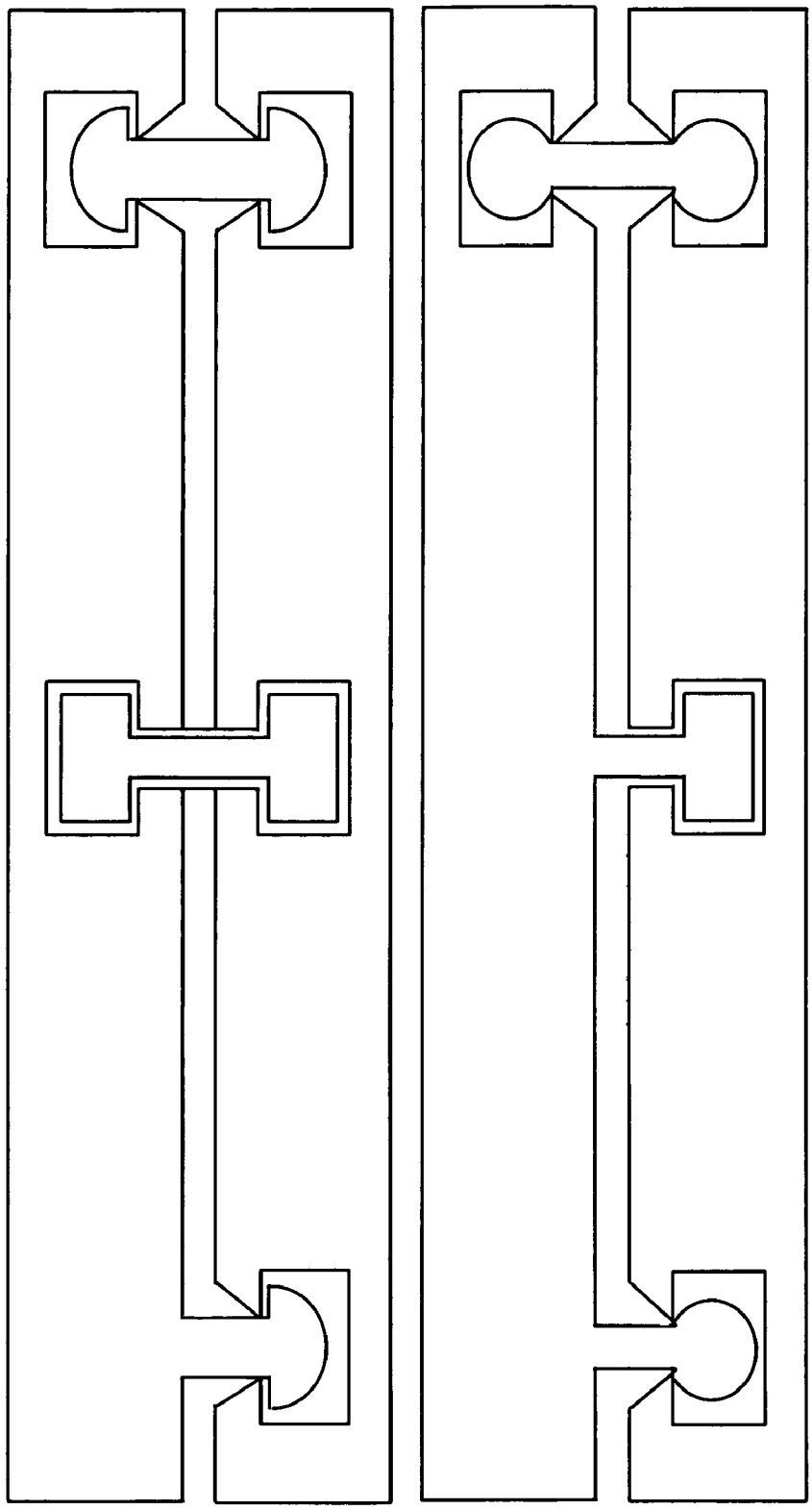

As shown in FIGS. 4 and 5, the panels can be coupled together using a pin and slot configuration. In this regard, it is envisioned that a first elongated panel 40 has a plurality of pins 30 which are slidably received within a slot defined within the second member 42. As shown in FIG. 5, the pins can be free floating within the slot 34 or can be coupled directly to an adjacent member. It is envisioned that the pins can have a plurality of head configurations of with either flat or curved interface surfaces. In this regard, the surfaces of the slots can be angled to interface with flat or curved surfaces of the pin or pin head.

It is envisioned that the system 26 can be coupled to the door or frame using fasteners such as screws nails or adhesives. The elongated members can be directly coupled to the frame and door, using a flange which is fixed to the elongated member. This flange can be pivotably or rigidly fixed to one elongated members.

Figure 6:
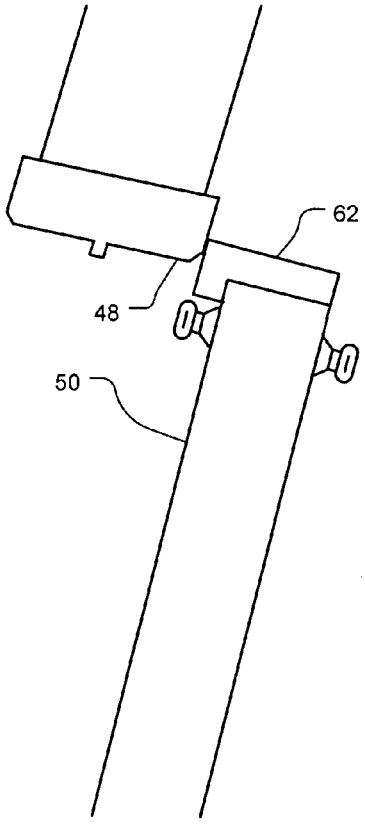
FIG. 6-10 represent an alternate embodiment of the invention.
Figure 7:
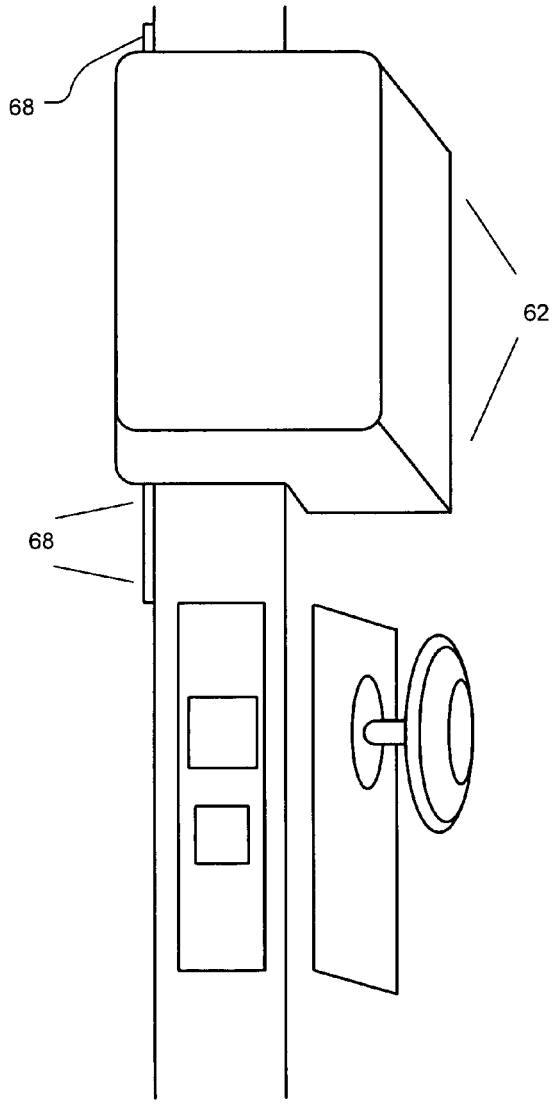

FIGS. 6-10 represent another embodiment which can be used with the system described above. The safe door stop 62 is configured to prevent injury to hands and fingers caused by contact with a door while being closed. As shown in FIG. 6, the safe door stop 62 is designed to prevent injuries occurring between the door 50 and the jamb 48 at the door knob edge of the door.

The safe door stop prevents injury by placing a soft barrier between the door and the door jamb automatically whenever the door is opened. Removing the barrier requires a user closing the door to pause and complete the final few inches of closing the door slowly with both hands. The necessity of using two hands requires that the closer face the door thereby increasing visibility and therefore safety. In addition the necessity of pausing and completing the final few inches slowly when closing a door gives anyone in close proximity to the door more time to see the door being closed, and move hands or fingers out of harms way. The safe door stop also prevents a door from being slammed or closed from behind.

Figure 8:
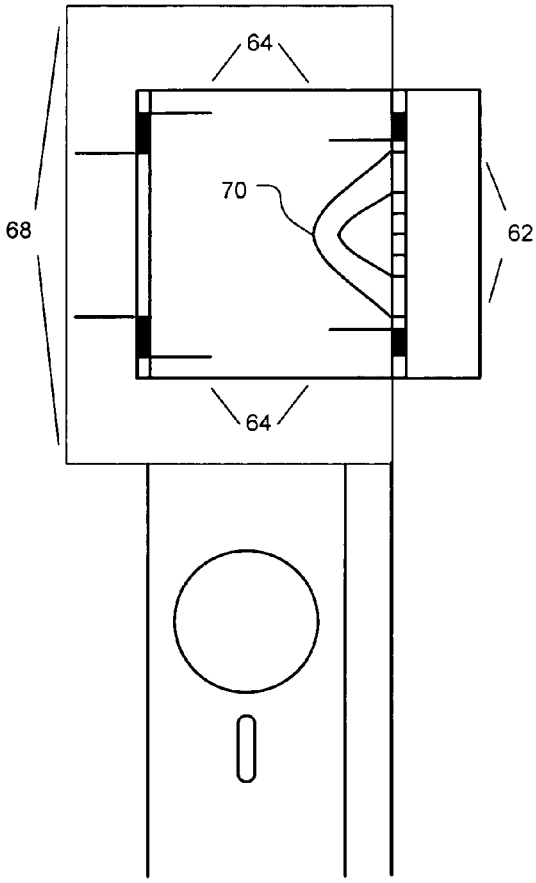
Figure 9:
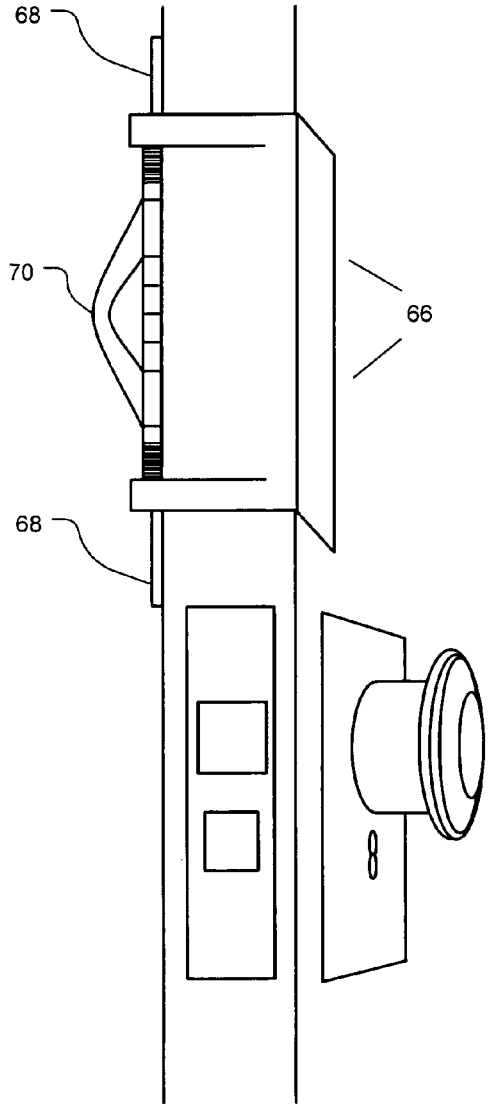
Figure 10:
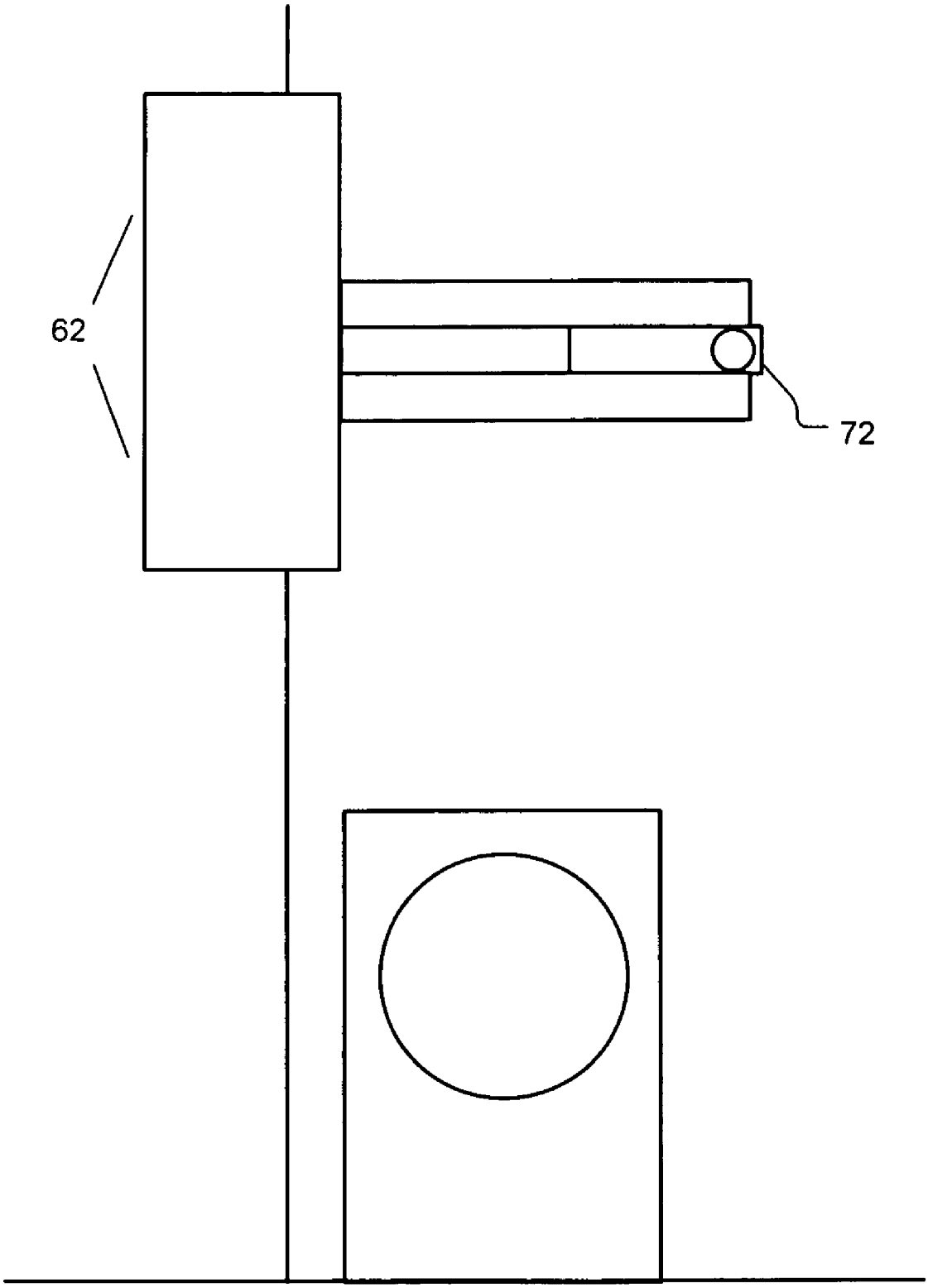

The safe door stop 62 can consist of a soft stopper 63 coupled to a member to form a pendulum. As shown in FIGS. 8-10, a spring operated extension arm consisting of two hinged plates, a door face plate 64 and a door edge plate 68, and a holding bracket to secure the safe door stop to the door. It is envisioned the extension arm could also be of one piece design. The safe door stop operates automatically whenever a door is opened. As the door opens, door faces plate 64 is brought into full contact and held on the door face. As the door continues to open, door edge plate 66 with attached soft stopper 62 (FIG. 6) is brought into full contact and held on the edge of the door. To close the door, a handle 70 can be used to assist in holding the safe door stop away from the edge of the door when pushing the door closed, and a spring operated pusher 72 would be mounted on the opposite side of the door to push and hold the safe door stop away while pulling the door closed. Optionally, a locking mechanism can be used to position the locking pendulum into a disengaged position which would allow the normal opening and closing of the door.

The soft stopper could be a variable size and density sufficient enough to stop a door from closing while leaving a gap large enough to prevent any part of the door from contacting hands or fingers that may be in the path of the door. The holding bracket would be attached to the door with Velcro™ or could be attached in any other secure manner such as a nail, screw, bolt or adhesive.

What is claimed is:

1. A door gap finger guard comprising:

a first elongated rigid fixed plate, said first elongated rigid plate defining a plurality of slots, said first elongated rigid fixed plate being rotatably and fixedly attached along an inner surface of a door jamb; and a second elongated rigid moveable plate having a plurality of pins disposed in the slots, said second elongated rigid moveable plate extending along a parallel direction to said rigid fixed plate, said moveable plate being slotably coupled to the first elongated fixed plate, wherein a free edge of said rigid moveable plate is adapted to be rotatably coupled to a door, and wherein said second elongated rigid moveable plate slides parallel and adjacent to said first elongated rigid plate when the door is moved from a first position to a second position.

2. The door gap finger guard of claim 1, wherein said fixed rigid plate and said moveable plate are generally coplanar.

3. The door gap finger guard of claim 1, wherein said first elongated rigid fixed plate is curved.

4. The door gap finger guard of claim 3, wherein said elongated rigid moveable plate is curved.

5. The door gap finger guard of claim 1, wherein said first elongated fixed plate defines a slot and the moveable plate defines a plurality of pins disposed within the slot.

6. The door gap finger guard of claim 1, further comprising a first hinge disposed between the door jamb and the first elongated rigid plate.

7. The door gap finger guard of claim 6, further comprising a second hinge disposed between the door and the moveable plate.

8. The door gap finger guard of claim 1, further comprising a plurality of coupling pins and wherein the first elongated fixed plate defines a first slot and a moveable plate defines a second slot, said coupling pins being disposed within the first and second slots.

* * * * *